United States Patent [19]

Steiner et al.

[11] Patent Number: 4,865,775

[45] Date of Patent: Sep. 12, 1989

[54] HUMIDIFIER WITH FLOATING WICK ASSEMBLY

[75] Inventors: Robert E. Steiner; Terrence L. Stanek, both of St. Louis, Mo.

[73] Assignee: Emerson Electric Co., St. Louis, Mich.

[21] Appl. No.: 257,719

[22] Filed: Oct. 14, 1988

Related U.S. Application Data

[63] Continuation-in-part of Ser. No. 156,598, Feb. 17, 1988, Pat. No. 4,822,533, which is a continuation-in-part of Ser. No. 940,444, Dec. 11, 1986, abandoned.

[51] Int. Cl.[4] ..... B01F 3/04

[52] U.S. Cl. ..... 261/24; 261/120

[58] Field of Search ..... 261/120, 24, 29

[56] References Cited

U.S. PATENT DOCUMENTS

| | | | |
|---|---|---|---|
| Re. 31,675 | 9/1984 | Vesper | 98/100 |
| 182,345 | 9/1876 | Bickford | 261/120 |
| 353,311 | 11/1886 | Keller | 261/70 |
| 362,197 | 5/1887 | Bennett | 261/120 |
| 629,581 | 7/1899 | Martenette | 261/120 |
| 701,890 | 6/1902 | Keller | 261/120 |
| 828,334 | 8/1906 | Peterson | 261/70 |
| 951,590 | 3/1910 | Brown | 261/120 |
| 1,064,102 | 6/1913 | Smith et al. | 261/120 |
| 1,447,336 | 3/1923 | Baughman | 261/120 |
| 1,912,480 | 9/1932 | Houlis | 261/92 |
| 2,031,055 | 2/1936 | McKinney | 261/70 |
| 2,118,695 | 5/1938 | Bahnson | 261/91 |
| 2,377,527 | 6/1945 | Siefken | 261/104 |
| 3,045,450 | 7/1962 | Chandler | 261/104 |
| 3,188,007 | 6/1965 | Myklebust | 261/91 |
| 3,220,707 | 11/1965 | Weatherston et al. | 261/91 |
| 3,283,478 | 11/1966 | Katzman et al. | 261/91 |
| 3,287,002 | 11/1966 | Sevald | 261/92 |
| 3,290,021 | 12/1966 | Blachly et al. | 261/91 |
| 3,294,376 | 12/1966 | Eranosian | 261/91 |
| 3,306,010 | 2/1967 | Garofalow et al. | 261/142 |
| 3,348,821 | 10/1967 | Martin et al. | 261/91 |
| 3,348,822 | 10/1967 | Vieceli et al. | 261/91 |
| 3,552,097 | 1/1971 | Grasseler | 55/230 |
| 3,552,725 | 3/1969 | Ray | 261/119 |
| 3,782,081 | 1/1974 | Munters | 261/112.2 |
| 3,864,437 | 2/1975 | Blaszkowski | 261/120 |
| 3,914,349 | 10/1975 | Stipanuk | 261/91 |
| 3,953,551 | 4/1976 | Dorall | 261/91 |
| 4,045,523 | 8/1977 | Goettl | 261/29 |
| 4,051,205 | 4/1977 | Grant | 261/70 |
| 4,147,524 | 4/1979 | Smith et al. | 55/521 |
| 4,217,315 | 8/1980 | Keeler, II | 261/120 |
| 4,222,971 | 9/1986 | Eilert | 261/92 |
| 4,226,174 | 10/1980 | Vesper | 98/100 |
| 4,301,094 | 11/1981 | Baus | 261/29 |
| 4,350,646 | 9/1982 | Baus | 261/29 |
| 4,362,090 | 12/1982 | Whiteley | 261/94 |
| 4,448,593 | 5/1984 | Spiers | 261/120 |
| 4,610,706 | 9/1986 | Nesker | 55/497 |
| 4,698,188 | 10/1987 | Gutmann | 261/120 |
| 4,699,737 | 10/1987 | Engstrand | 261/120 |

FOREIGN PATENT DOCUMENTS

| | | | |
|---|---|---|---|
| 54100 | 1/1938 | Denmark | 261/112.2 |
| 3312367 | 10/1984 | Fed. Rep. of Germany | 261/120 |
| 3508615 | 9/1986 | Fed. Rep. of Germany | 261/120 |
| 23284 | of 1911 | United Kingdom | 261/120 |
| 129967 | 8/1920 | United Kingdom | 261/120 |

*Primary Examiner*—Tim Miles

*Attorney, Agent, or Firm*—Polster, Polster and Lucchesi

[57] ABSTRACT

A room humidifier is disclosed as having a reservoir tank containing a freely and independently floatable wick element providing a constant evaporative area as the water level in the tank rises and falls. A fan is mounted in fixed position relative to an upper end of the tank. An extensible and collapsible closed air path is provided between the wick element and the fan, and an outside air flow path extends between open upper areas of the tank and the wick element, while also being in air flow communication with the fan. When the fan is operated, air is drawn into the outside air flow path for contact with the constant evaporative area of the wick element, while also drawing air with increased humidity through the constant evaporative area of the wick element as well as upwardly through the closed air flow path for discharge from the humidifier into the surrounding atmosphere.

10 Claims, 6 Drawing Sheets

HUMIDIFIER WITH FLOATING WICK ASSEMBLY

CROSS REFERENCE TO RELATED APPLICATIONS

The present invention is a continuation-in-part of Ser. No. 156,59, filed Feb. 17, 1988, now U.S. Pat. No. 4,822,533, which was, in turn a continuation-in-part of Ser. No. 940,444 filed Dec. 11, 1986, now abandoned.

BACKGROUND OF THE INVENTION

The present invention relates to a humidifier with a floating wick element that operates with a closed air flow path within the humidifier for discharging air with increased humidity from the humidifier.

Humidifiers are typically used during the winter heating season to increase the humidity levels within heated rooms that normally tend to have a low moisture contact as the result of being filled with heated outside air. Among the problems associated with low relative humidity include discomfort to the occupants of the rooms, drying out of furniture and plants, excessive static electricity, and numerous other problems.

In our prior co-pending patent application Ser. No. 156,598 filed Feb. 17, 1988, now U.S. Pat. No. 4,822,533, we have disclosed some of the varieties of types of humidifiers that have been developed including centrifugal pump/evaporative filter humidifiers, air blown wicking/evaporative element humidifiers; motor driven belt pad or wicking element humidifiers; and other types. We have also disclosed some of the long standing problems associated with all of the above described types of humidifiers.

As disclosed in part in our prior co-pending patent applications Ser. No. 156,598 filed Feb. 17, 1988, now U.S. Pat. No. 4,822,533, the present invention relates to a humidifier which maintains a constant evaporative area of a wicking element independently floatable on water within a reservoir tank, which is part of a closed air flow path including a fixedly mounted fan for discharging air within increased humidity from the humidifier. The humidifier of the present invention requires no float control valves, pumps, rotary drives, rotary belts or any other type of mechanical drive member except the fan. The wick element collects both soluble and insoluble mineral deposits, and the wicking element may be readily and periodically removed from the humidifier for cleaning or replacement, thus, preventing accumulations of solid particles or insoluble mineral deposits in the humidifier, except within the wicking element.

The present invention is the commercial embodiment of our above described humidifier, which retains all of the features and advantages of our prior designs, while substantially improving and simplifying the construction and operation of our humidifier, all of which will become apparent in the description that is to follow.

SUMMARY OF THE INVENTION

Among the several objects and advantages of the present invention may be noted:

the provision of a new and improved room humidifier which overcomes all of the previously known deficiencies of prior art devices, while providing substantially improved designs in the actual construction of the herein disclosed humidifiers;

the provision of the aforementioned humidifier which includes independent floatable wick elements having a constant evaporative surface above the water, regardless of the water level, while also enabling air to be drawn into and passed through the floating wick element in a simplified flow path or versatile duct structure within the humidifier;

the provision of the aforementioned humidifier which provides an outside air flow path that enables a fixedly mounted fan to draw air downwardly into the humidifier and into contact with the wicking element, with the wick element also being a part of an extensible and collapsible closed air flow path, thereby permitting air to be drawn through the wicking element and up into the extensible and collapsible closed air flow path, for discharge from the humidifier with increased humidity;

the provision of the aforementioned humidifier in which the fixedly mounted fan is constructed to be part of both the outside air flow path and collapsible closed air flow path, while also substantially sealing the air flow paths from each other;

the provision of the aforementioned humidifier wherein the wick element is contained within a supporting housing slidably mounted relative to opposing walls of the housing, to establish the aforementioned extensible and collapsible closed air flow path, while also enabling the supporting housing to be removed from the humidifier for changing or replacement of the wick element(s);

the provision of the aforementioned humidifier which incorporates a splash guard to prevent splashing of water during the filling or use of the humidifier; and the provision of the aforementioned humidifier which is of low cost, is reliable in operation, has a minimum number of moving parts, requires a minimum amount of service, is quiet and reliable in operation, and is otherwise well adapted for the purposes intended.

Briefly stated, a humidifier of the present invention includes a water reservoir tank for holding a supply of water. A fan is mounted in fixed position relative to an upper end of the reservoir tank. At least one freely and independently floatable wick element extends across the reservoir tank and is in operative association with the water. The wick element includes an evaporative surface which extends a substantially uniform and predetermined amount above the water as the water level in the tank rises and falls to provide a constant evaporative area for the wick element. An extensible and collapsible closed air flow path is provided between the wick element and the fan, and an outside air flow path extends within the reservoir tank as well, and communicates between substantially open upper areas of the tank and a part of the constant evaporative area of the wick element, which extends outside of the closed air flow path. The fan operates above the closed air flow path so as to be in air flow communication with the outside air flow path, such that when the fan is operated to draw air from the outside into the outside air flow path for contact with the constant evaporative area of the wick element, the fan also draws air with increased humidity through the constant evaporative area and upwardly through the closed flow path means for discharge from the humidifier into the surrounding atmosphere.

Preferably, a pair of spaced and independently floatable wick elements each contained within a supporting housing are provided and are slidably mounted relative to opposing walls of the reservoir tank. The supporting housings are spaced from each other and include an upper wall panel extending between the opposing walls and also being slidably mounted with respect thereto so as to define the extensible and collapsible air flow path between the slidable upper wall panels of the spaced supporting housings and interengaged opposing walls of the reservoir tank. The reservoir tank includes louvers along an upper transverse top and at least partially along an upper area of the walls of the reservoir tank, which communicates with the fan above the closed air flow path. The outside air flow path extends outside of the slidable wall panels and interengaged opposing walls of the reservoir tank, enabling air to be drawn therein by the fan for contact with the wicking elements and for subsequent withdraw through the extensible and collapsible air flow path for discharge from the humidifier.

The reservoir tank is generally rectangularly-shaped with two opposing pairs of longer and smaller side walls, with the supporting housings containing the wick elements extending between the smaller pair of side walls. The upper wall panels including the supporting housings have aligned tracks on opposite sides thereof for complementary engagement with corresponding aligned grooves provided in the smaller pair of opposed side walls of the reservoir tank for cooperation with each supporting housing. Each supporting housing comprises an open-ended rectangular-shaped housing with the upper wall panel thereof being centrally located and extending vertically upwardly from each supporting housing.

Each supporting housing further includes a splash guard centrally positioned relative to and supported by each supporting housing and upper wall panel, and extending transversely from each respective upper wall panel of the supporting housing and extending towards one of the longer side walls of the reservoir tank, to prevent splashing of water from the reservoir tank during pouring of water therein or during use thereof. Each supporting housing is mounted on a floatable base in order to position the wick elements contained therein, with the constant evaporative area relative to water within the reservoir tank, as described above. Each wick element is preferably a cartridge which may be readily removed from the supporting housing when the latter is slidably removed from the reservoir tank. Each wick element also preferably comprises a core of sheet wicking material with air passageways therethrough enabling water to be retained by the sheet wicking material, but allowing the water to be removed therefrom as increased humidity is included in air passing through the air passageways.

The fan is fixedly mounted to and supported within the fan housing and having open areas above the extensible and collapsible air flow path for air communication with the closed air flow path. The fan housing also includes elongated sealing gaskets on opposite sides thereof for sliding sealing engagement with the upper wall panels of the supporting housing to maintain the integrity of the closed air flow path.

BRIEF DESCRIPTION OF THE DRAWINGS

In the drawings

Corresponding reference numerals will be used throughout the several figures of the drawings.

BRIEF DESCRIPTION OF PREFERRED EMBODIMENTS

As described above, the present invention is a new and improved commercial embodiment of the constructions disclosed in our prior aforementioned patent applications, and incorporates features disclosed in such prior constructions in a new and improved system with new improved components, as will become apparent from the description that follows.

Figure 1:
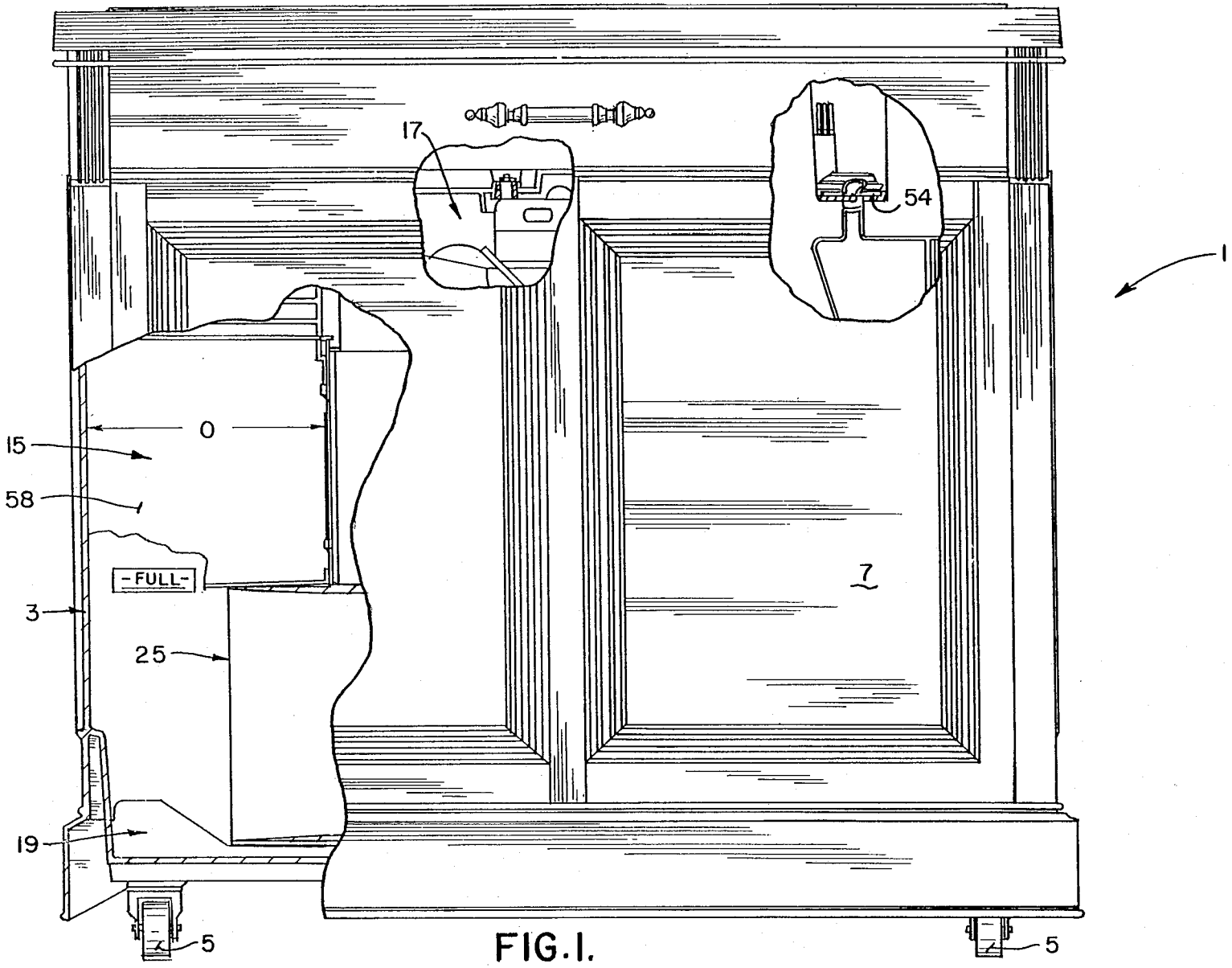
FIG. 1 is a fragmentary front elevational view of a humidifier with floating wick assembly constructed in accordance with the teachings of the present invention.
Figure 5:
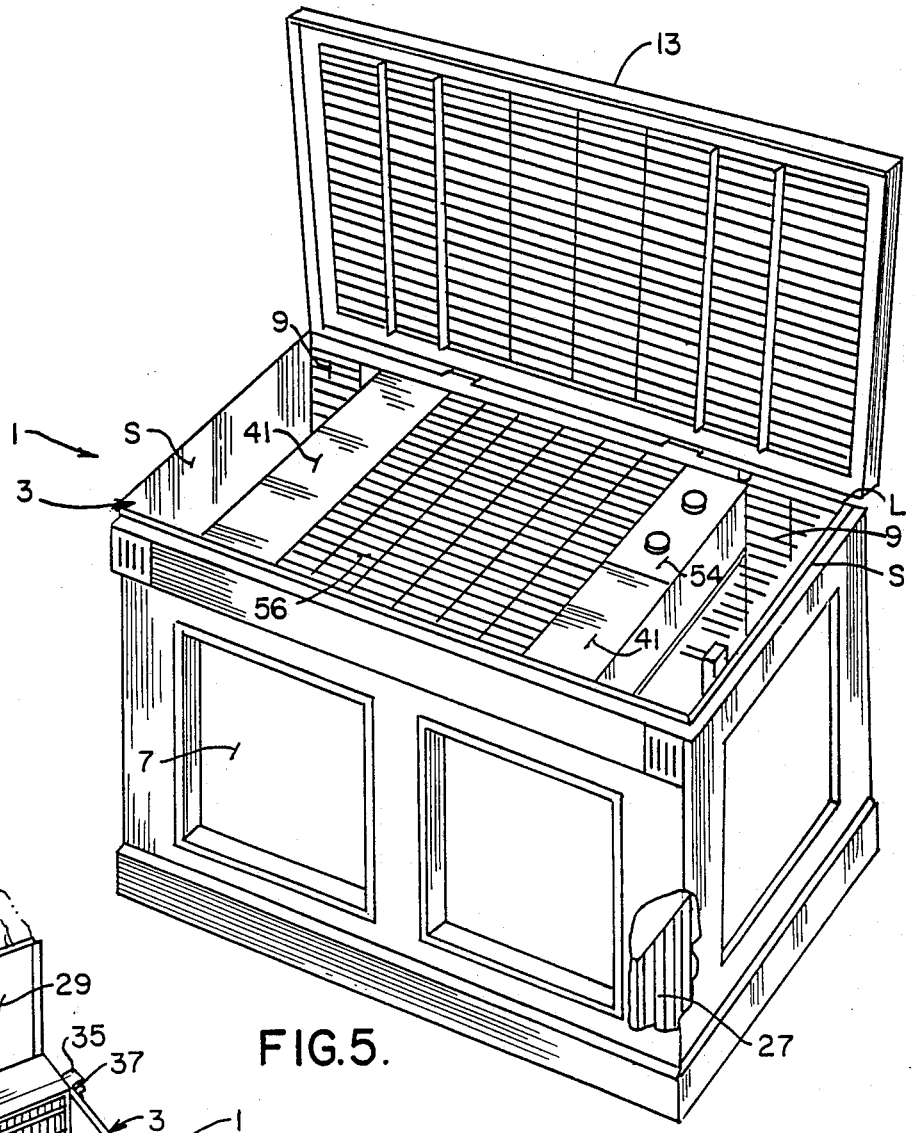
FIG. 5 is an isometric view of the humidifier of the present invention with the top louvered panel raised to permit a user to pour water within the reservoir tank or compartment thereof.

Referring now to the drawings, a portable room humidifier of the present invention is indicated in its entirety by reference character 1. A humidifier 1 includes a reservoir tank 3 for holding a supply of water W (see FIG. 6), with the reservoir tank 3 mounted on casters 5 such that the humidifier 1 may be rolled to any location that may be desired. As best seen in FIGS. 1 and 5 of the drawings, a cabinet-like enclosure 7 with various hardware, such as drawer pulls and the like as may be desired, extends around the reservoir tank 3. The cabinet-like enclosure 7, and the reservoir tank 3 may be formed together as a molded unit, or attached to one another, or may be formed as separate shells, one within the other, as may be desired.

Figure 4:
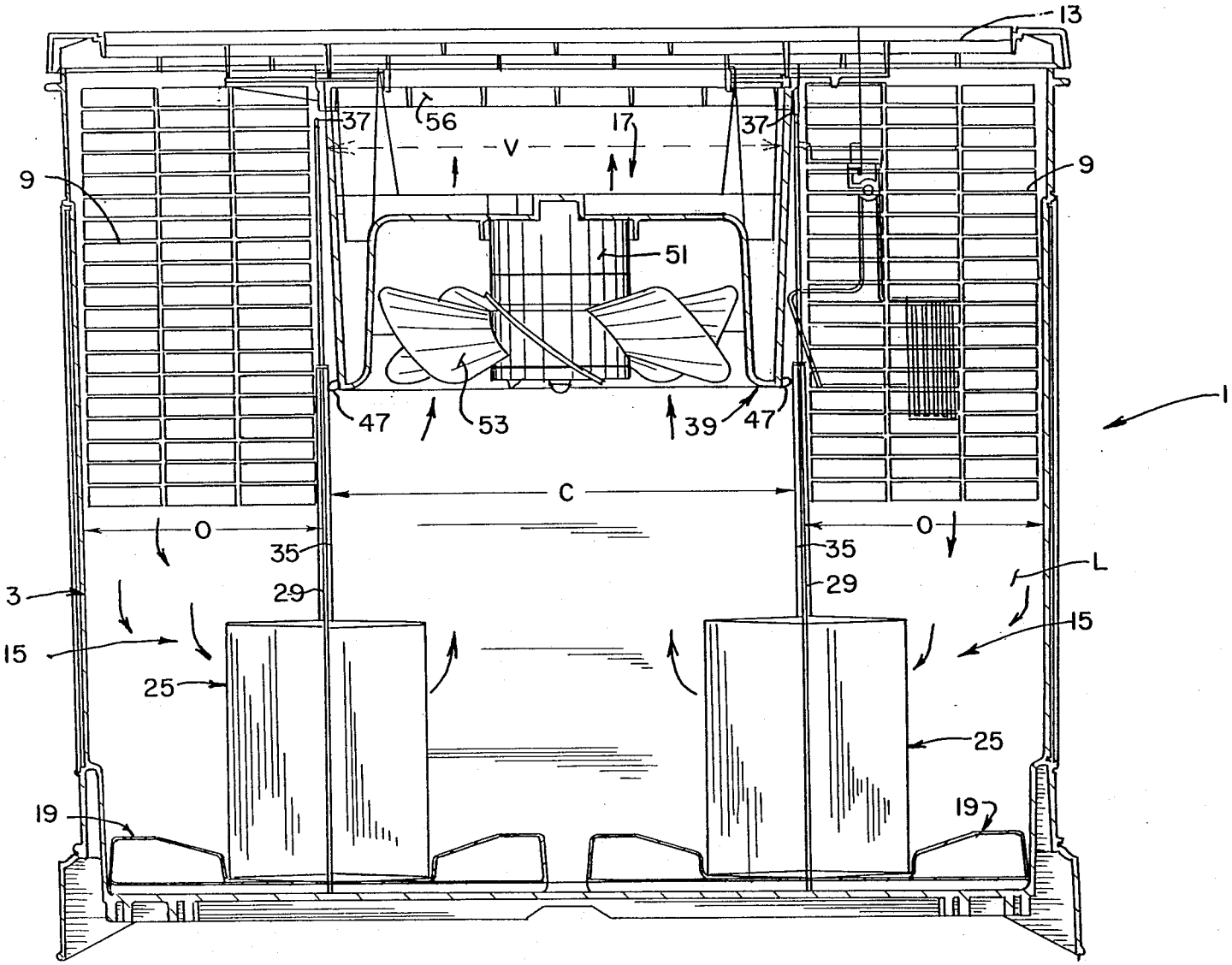
FIG. 4 is a front elevational view of the humidifier shown in FIG. 1 of the drawings with the decorative front panels removed.
Figure 8:
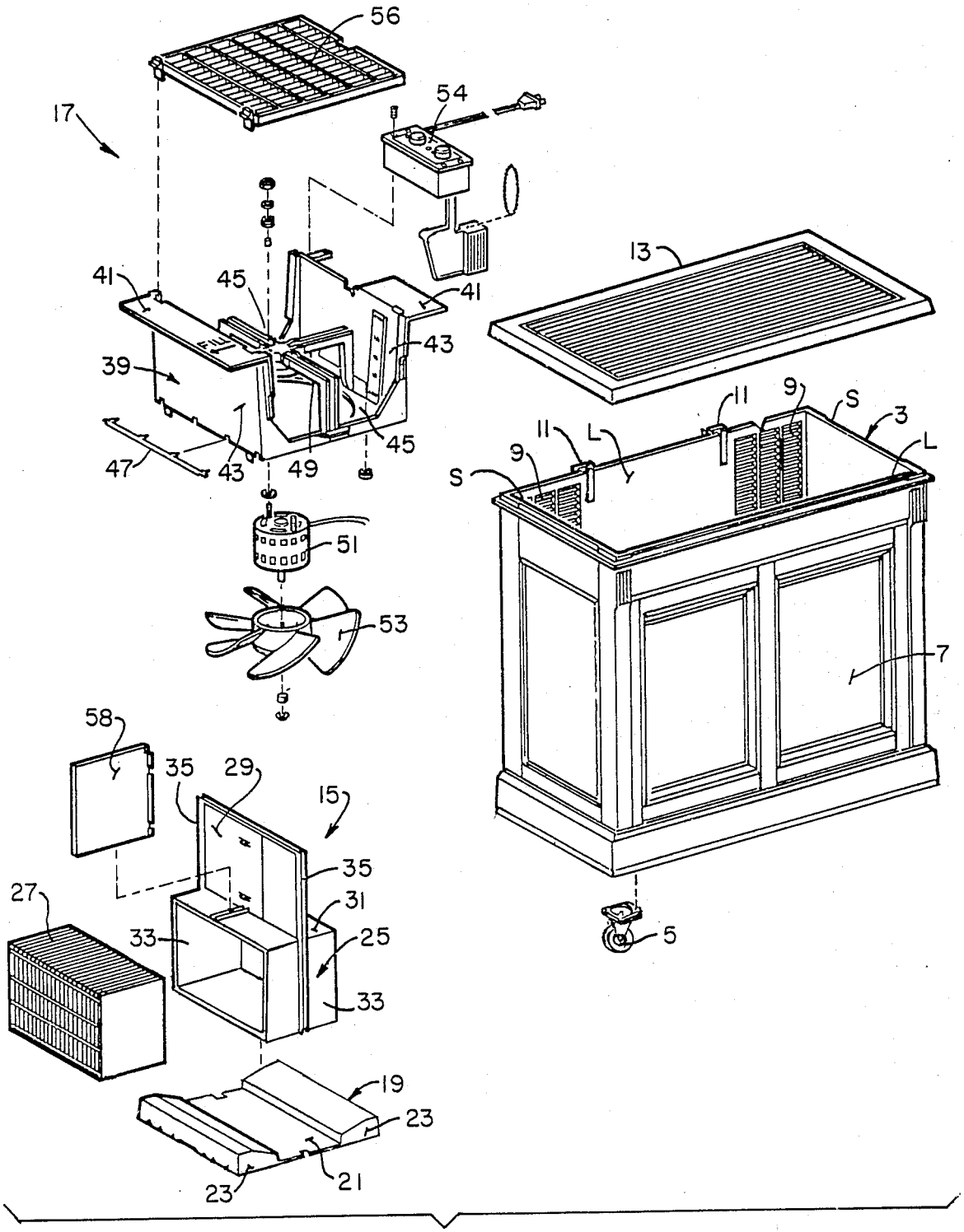
FIG. 8 is an exploded perspective view of the humidifier of the present invention illustrating the various components and elements used in the construction and operation thereof.

The reservoir tank 3, including the cabinet like enclosure 7, is illustrated in the drawings as being generally rectangular-shaped with two opposing pairs of longer and smaller side walls generally designated L and S respectively. As best seen in FIGS. 4–5 and 8 of the drawings, the longer side wall L at the rear of the humidifier includes spaced louvers 9, 9 at opposite ends thereof, to allow outside air to be drawn into the humidifier. The louvers 9, 9 may be formed as integral louvered sections incorporated within the reservoir tank, including the cabinet-like enclosure 7, in a well known manner. In this same rear longer wall L of the reservoir tank 3, integral spaced hinge elements 11, 11 may also be provided in order facilitate the mounting of a louvered top 13. As shown in FIG. 5 of the drawings, the louvered top 13 may be pivotally moved to an open position to enable user of the humidifier 1 to pour water into the reservoir tank 3, according to operating instructions. Both the spaced louvers 9, 9 in rear longer wall L and the louvered top 13 enable outside air to be drawn into the humidifier 1, as will be described in detail below.

Although the operating components of the humidifier 1, now to be described are relatively of simple construction and operation, they are uniquely constructed and structurally interrelated to one another in a new and improved way to provide humidifier 1 with economical and low maintenance operation that also provides increased relative humidity, all of which will be described in detail below.

The principal operating components of the humidifier 1 include, as best seen the exploded perspective view of FIG. 8, a floating wick assembly 15 and a fan assembly 17, both of which are mounted with respect to the reservoir tank 3, as will be described below.

In the humidifier illustrated in the drawings, there are two floating wick assemblies 15, 15 contained within the reservoir tank, although it is conceivable the humidifier 1 could be modified to provide only a single floating wick assembly 15, if desired. In the preferred embodiment, each of the two floating wick assemblies 15, 15, contained within the reservoir tank 3, includes a floatable base 19 that is sized relative to the other floatable base 19 and the interior of the reservoir tank 3 to enable the floatable bases 19, 19 to rise or fall, dependent on the level of the water W within the reservoir tank. As illustrated in the drawings, each floatable base 19 includes a flat or planar median portion 21, having opposite sides which are integrally connected to opposite, enclosed float sections 23, 23.

Resting upon the median portion 21 intermediate the float sections 23, 23 of each floatable base 19 is an open-ended rectangular-shaped supporting housing 25 that is suitably configured to be received therein. The open ended, rectangularly shaped supporting housing 25 is constructed to receive the wick cartridge 27 therein, prior to the supporting housing being mounted as described above with respect to the floatable base 19.

Each wick cartridge 27 includes a wick element or core formed of suitable sheet-like, absorbent capillary wick material, as is described in detail in our co-pending patent application Ser. No. 156,598, filed Feb. 17, 1988, now U.S. Pat. No. 4,822,533. For purposes of the present invention, it is sufficient to note that the cartridge or core 27 has sheet wicking material with air passages therethrough for enabling water to be first retained by the sheet wicking material and then removed as increased humidified air passing through the air passageways. It has been discovered that wicking cartridges or cores constructed as described our aforementioned copending patent application enables same to be totally saturated with water, through its capillary action, within a relatively short period of time, for example about 30 minutes.

Figure 7:
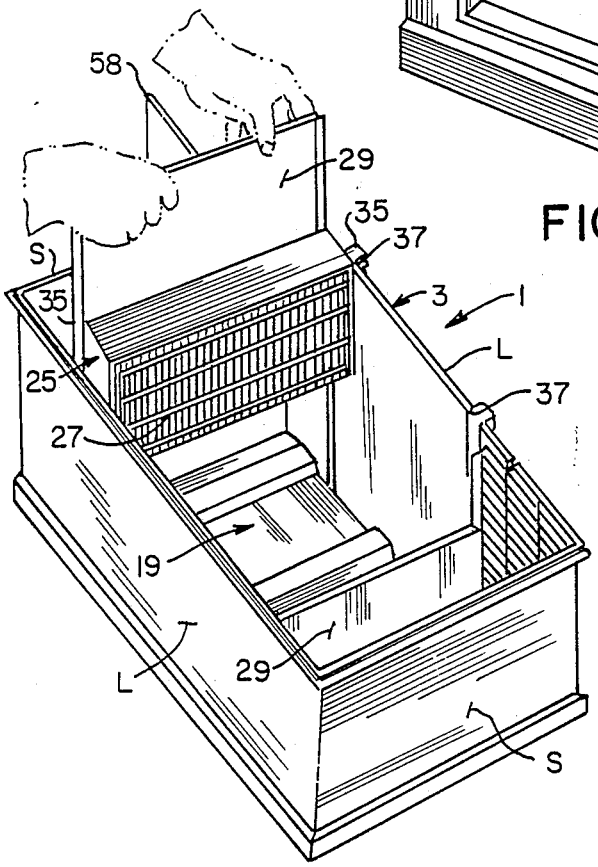
FIG. 7 is a top perspective view illustrating the manner in which the floating wick assembly may be inserted and/or removed from the humidifier for replacement or cleaning thereof.

To facilitate cleaning and/or replacement of the cartridges 27, each of the supporting housings 25 include a generally vertically extending upper wall panel 29 integrally formed and centrally located relative to the upper surface 31 of each open ended, rectangularly shaped supporting housings 25. Thus, it will be understood that a user may simply grasp the upper wall panel 29, integrally associated with the supporting housings 25, to facilitate insertion and/or removal of the supporting housing 25 and the wick cartridge 27 mounted therein, for cleaning and/or replacement thereof. In addition, the upper wall panel 29 of each supporting housing 25 cooperates with spaced elongated walls L, L to provide an extensible and collapsible closed air flow path between the floatable wick cartridges 27, 27 of each floatable wick assembly 15 and a fixedly mounted fan at the upper end of the reservoir 3, to be described hereafter. More specifically, opposite vertically extending edges of the generally vertically extending upper wall panel 29, and continuing along the outer surfaces of the spaced vertically extending wall sections 33, 33 of the supporting housings 25 include male track elements 35, 35, on opposite sides thereof. As best seen in FIG. 7, the opposite longer walls L, L of the rectangularly-shaped reservoir tank 3 include corresponding aligned grooves 37, 37 in the spaced longer walls L, L for receiving the male track elements 35, 35 of each supporting housing 25, in complementary slidable engagement therewith. As a result, each supporting housing 25 and integral upper wall panel 29 associated therewith are suitably configured and dimensioned relative to the interior of the reservoir tank 3 such that the opposite male tracks 35, 35 of each supporting housing 25 are slidably received within the generally vertically extending aligned grooves 37, 37 provided in the spaced longer walls L, L of the rectangular-shaped reservoir tank 3.

Figure 6:
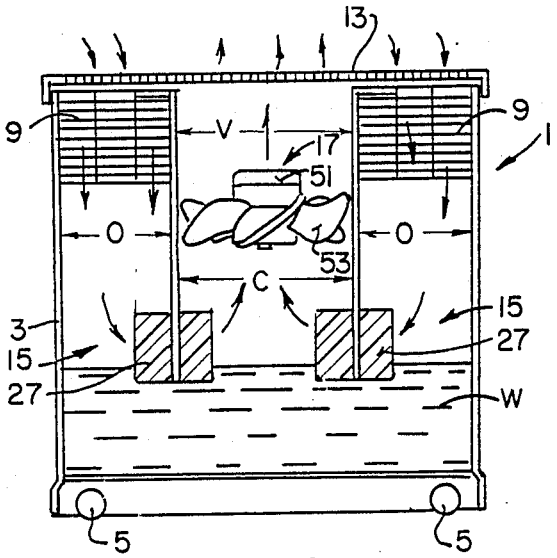
FIG. 6 is a front diagrammatic illustration depicting the manner in which outside air is drawn into the humidifier for contact with the floating wick assembly and the removal of air with increased humidity from the humidifier, all the foregoing being accomplished by the use of the single fan mounted in the humidifier.

The water level of the water W within the reservoir tank 3 not only causes the floatable wick assemblies 15, 15 to rise or fall with the water level, but the slidable interengagement of the opposite male track elements 35, 35 of each supporting housing 25, will slidably engage the cooperating aligned grooves 37, 37 of the oppositely positioned and spaced longer walls L, L of the rectangular-shaped reservoir tank 3, in order to provide the extensible and collapsible closed air flow path C, as best seen in FIGS. 4 and 6 of the drawings.

The fixedly mounted fan 17 is mounted in the upper end of the reservoir tank 3 within the confines of the extensible and collapsible closed air path C, as also best seen in FIGS. 4 and 6 of the drawings, to draw air upwardly from the spaced floating wick assemblies 15, 15 up into the extensible and collapsible closed air path C, below the fixedly mounted fan 17, and also thereabove, establishing the venturi V including the extensible and collapsible closed air path C.

Figure 2:
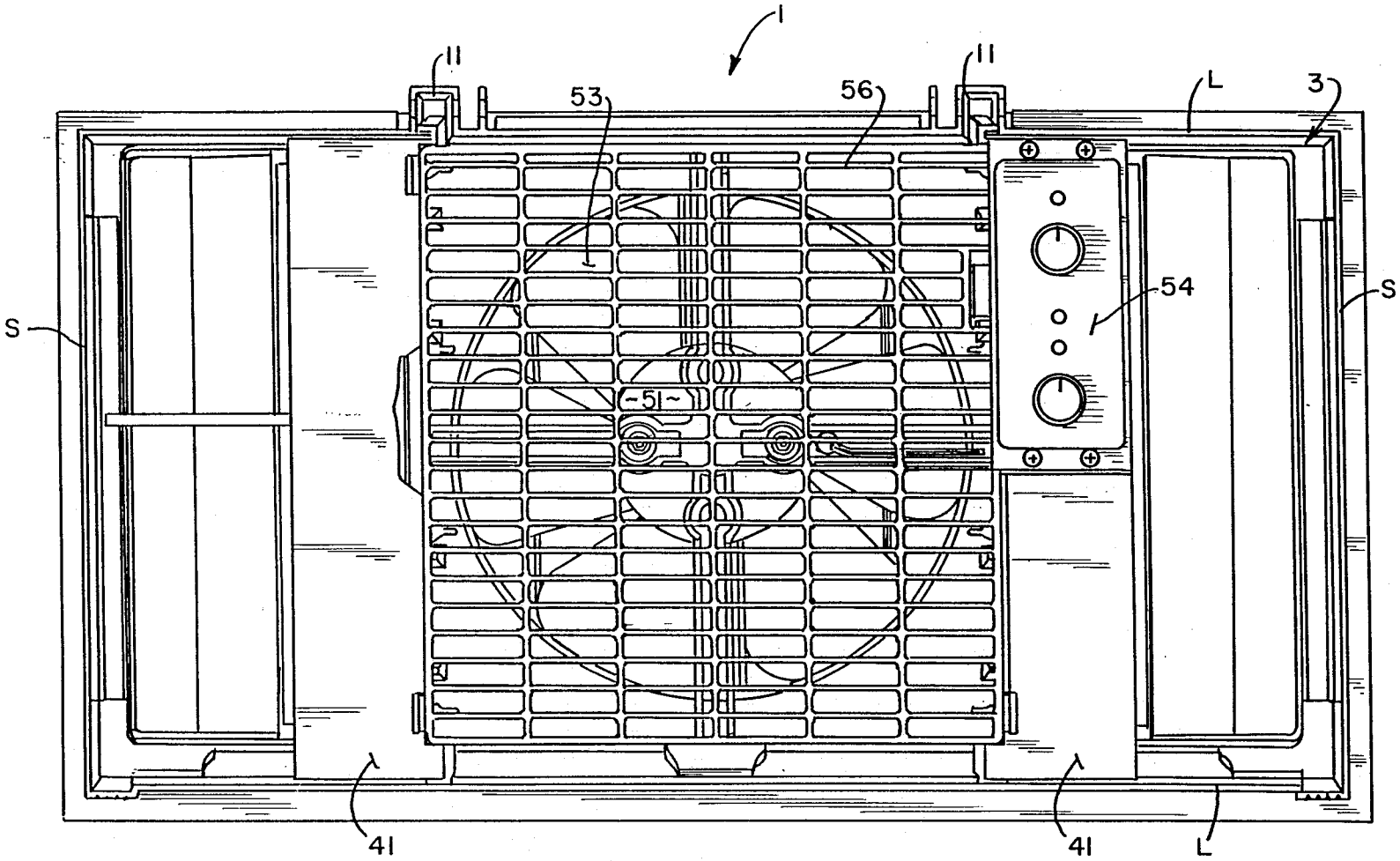
FIG. 2 is a top plan view of the humidifier shown in FIG. 1 of the drawings.
Figure 3:
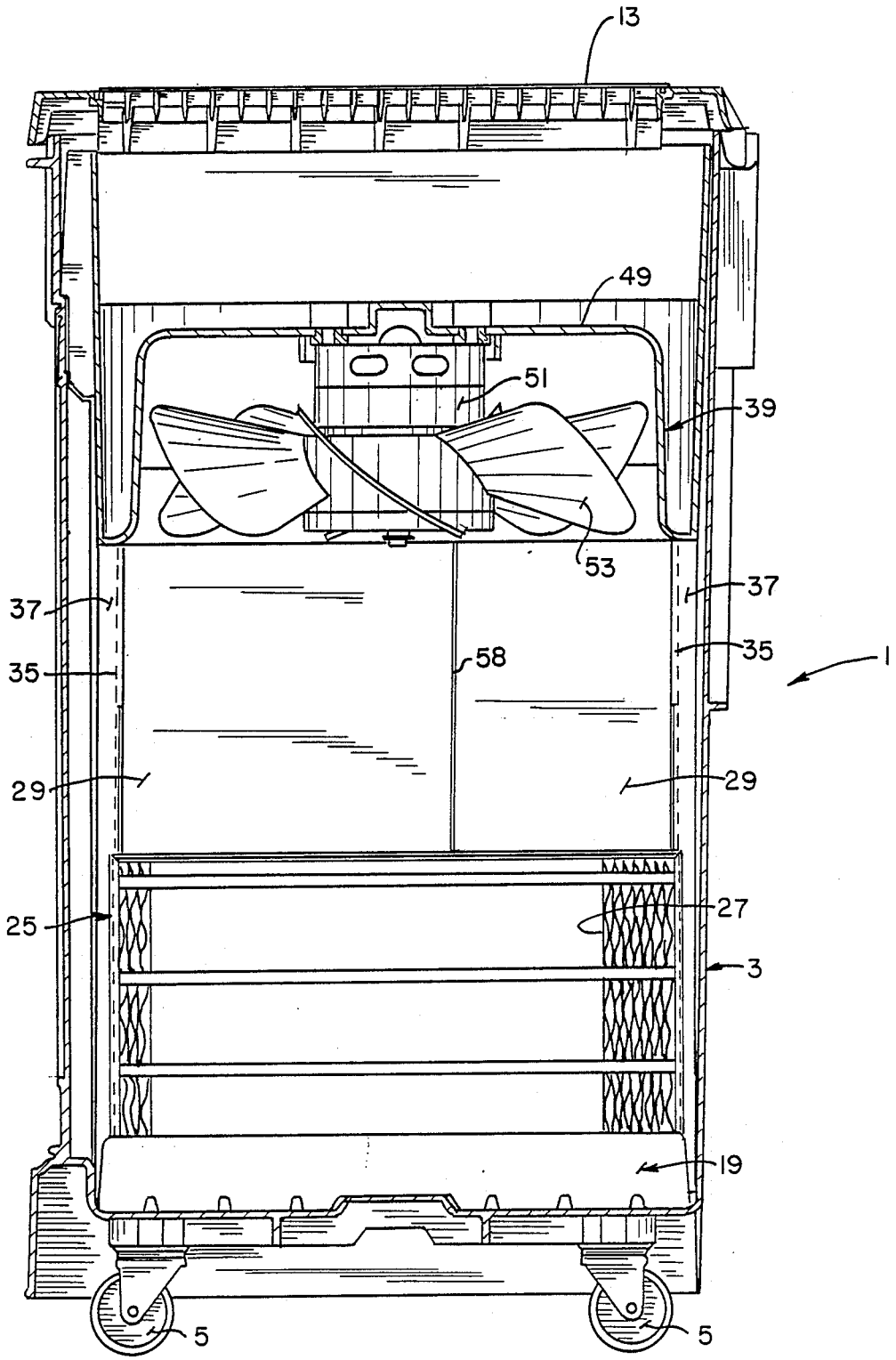
FIG. 3 is a vertical end sectional view of the humidifier shown in FIGS. 1–2 of the drawings.

As best seen in FIG. 8 of the drawings, the fixedly mounted fan 17 includes a fan housing 39 including spaced laterally outwardly extending flanges 41, 41 which overlie the upper ends of the spaced longer walls L, L, as shown in FIG. 2 of the drawings, for mounting the fan housing 39 relative to the reservoir tank 3. The fan housing 39 includes spaced closed sides 43, 43 extending below and connected to the laterally outwardly extending flanges 41, 41, and spaced and opposed open sides 45, 45 which serve to reduce the amount of material needed in the fan housing. An elongated air sealing gasket 47 is attached to each of the closed sides 43, 43 such that the elongated air sealing gaskets 47, 47 slidably engage the upper wall panels 29, 29 of each supporting housing, so as to maintain the integrity of the extensible and collapsible closed air flow path C. The slidable and sealed engagement with the spaced gaskets 47, 47 and the upper wall panels 29, 29 of each supporting housing 25 is best seen in FIG. 4 of the drawings.

When the fan housing 39 is fixedly mounted relative to the reservoir tank 3, the fan motor 51 and fan blade 53 are positioned for air flow communication with the louvered top 13 and the spaced louvered wall sections 9, 9 on the rear longer wall L of the reservoir tank 3, as part of the outside air flow path 0 on opposite sides thereof, within the reservoir tank 3, to be discussed further in detail below.

An integrally formed and connected spider element 49 extends within the fan housing 39 for fixedly mounting the fan motor 51 thereto by suitable fasteners as will be appreciated. The fan motor 51 includes a plurality of fan blades 53 mounted thereto in a well known manner. It will be understood that various types of fan motors and blades of various configurations may be mounted within the fan housing 39, as will be appreciated. For operating the fan motor 51 and associated fan blades 53, suitable controls 54, attached to one of the laterally outwardly extending flanges 4I of the fan housing 39, are provided. A fan guard 56 is also attached to the laterally outwardly extending flanges 41, 41 of the fan housing 39 for safety purposes, as will be apparent. The fan guard 56 also has spaced louvered areas therein in order that the fan motor 51 and associated fan blades 53 will draw air upwardly in the extensible and collapsible closed air flow path C, as well as above the fan motor 51 and associated fan blades 53, within the venturi V thereabove, to discharge air with increased humidity from the humidifier 1 into the surrounding atmosphere.

Reference is now made to FIGS. 4–7 for a description of the operation of the humidifier 1. A homeowner or other user can lift the pivotally mounted louvered top or cover 13 from the open upper end of the humidifier 1, exposing the reservoir tank 3. Water is then poured into the reservoir tank to a predetermined fill level (see FIG. 1). This filling operation may be carried out by pouring water from a bucket into the reservoir tank 3. In order to prevent water from splashing from the reservoir tank 3 through the spaced louvered areas 9, 9 in the rear longer wall L, a splash guard 58 is provided for each supporting housing 25. Each splash guard 58 extends transversely from a respective upper wall panel 29 and extends towards one of the shorter side walls S of the reservoir tank 3, so as to prevent water from splashing out through the spaced upper louvers 9, 9 in the rear longer wall L of the reservoir tank 3, as will be appreciated. Following the filling of the reservoir tank 3 to the appropriate fill level, the humidifier control 54 are operated so as to energize the fan 51 with associated fan blades 53, and the louvered top or cover 18 is then pivotally returned above the top of the reservoir tank 3.

When the water level of the water W is at its full mark relatively high within the reservoir tank 3, the floating wick assemblies 15, 15 will be in generally near, but spaced proximity relative to the undersurface of the fan blades 53, and the extensible-collapsible closed air path C will be in its collapsed position, substantially as shown in FIG. 6 of the drawings. As previously noted, the spaced floating wick assemblies 15, 15 are so constructed that they will, at all times, float with the supply of water W contained, within the reservoir tank 3, such that a uniform water level is maintained in operative association with the lower portion of the wick cartridges 27, 27. This maintains the lower regions of the wick cartridges or elements 27, 27 in contact with the water W. This ensures that the wick cartridges or elements 27, 27 will absorb water W from the water supply and, through capillary action, will allow the water W to move vertically within the absorptive sheet wicking material constituting the wick cartridges or elements 27, 27, for substantially uniform wicking of the wick cartridges or elements 27, 27.

Operation of the fan 51 and associated fan blades 53 draws room air downwardly into the reservoir tank 3 via the louvered cover or top 13, and the spaced louvered sections 9, 9 of the longer rear wall L since the floating wick assemblies 15, 15 enable the fan 51 ,and associated fan blades 53 to draw air therethrough and establish an air fl path therebetween.

It will be further noted that as outside air is drawn into the reservoir tank 3, it will be drawn therein on opposite sides outside of the extensible and collapsible closed air flow path C. As previously noted, because spaced supporting housings 25, including the upper wall panels 29 have male track elements 35, 35 on opposite sides thereof which slidingly engage within the aligned grooves 37, 37 in the spaced longer walls L, L, the area within the slidable upper wall panels 29, 29 and interengaged spaced longer walls L, L define the extensible and collapsible closed air flow path C. At the same time, the area between the slidable wall panels 29, 29 of each supporting housing 25 and the shorter side walls S, S of the reservoir tank 3, provide spaced outside air flow paths O, O on opposite sides of the extensible and collapsible closed air flow path C.

Air in the outside air flow paths O, O will be drawn into air flow engagement with exposed areas of the cartridges or elements 27, 27 that extend outside of the extensible and collapsible closed air flow path C, as best seen in FIG. 6 of the drawings. As air is drawn into the extensible and collapsible closed air flow path C through the spaced wick cartridges or elements 27, 27, air with increased moisture content, will be drawn through the wick cartridge or elements 27, 27, then through the extensible and collapsible closed air flow path C, and finally discharged upwardly through the venturi V into surrounding atmosphere from the humidifier 1. As a result, increased moisture content air is discharged into a room by the humidifier 1 so as to increase the relative humidity within the room containing the humidifier 1.

It will be noted that a constant evaporative area of the wick cartridges or elements 27, 27, which extends a substantially uniform and predetermined amount above the water W, will continuously expose the constant evaporative area to air flow, as the water level in the reservoir tank 3 rises and falls. This provides a constant evaporative area for the wick cartridges or elements 27, 27. It will further be noted that the fixedly mounted fan 17 serves both the outside air flow path O, O on opposite sides, as well as the extensible and collapsible closed air flow path C therebetween, as a result of the slidable interengagement between the supporting housings 25, 25 and the spaced longer walls L, L of the reservoir tank 3. The fan 51 and associated blades 53 to draw air downwardly from the louvered top or cover 13 and the spaced upper louvered areas 9, 9 of the longer rear wall L through the wick cartridges or elements 27, 27 of the floating wick assemblies 15, 15 for establishing the outside air flow path O, O on opposite sides of the extensible and collapsible closed air flow path C, without interfering with either the venturi V above the fan 51 and associated fan blades 53, or the extensible and collapsible closed air flow path C below the fan 51 and associated fan blades 53. Thus, the fan 51 and associated fan blades 53 serve both the outside air flow path O, O on opposite sides of the extensible and collapsible closed air flow path C, without any interference of the air flow established in such paths.

From the foregoing, it will be noted that there are many advantages derived from the humidifier with floating wick assembly of the present invention. First, as noted above, since the fan 51, and associated fan blades 53, is the only powered or movable element of the humidifier 51, there is no requirement for motor powered pumps, rotary belts or rotary evaporative disks. Further, the fan 51 and associated fan blade 53 draws air within the outside air flow paths O, O, as well as exhaust air through the venturi V, including the extensible and collapsible closed air flow path C. Further, it will be noted that by providing the floating wick assemblies 15, 15, the wick cartridges or elements 27, 27 thereof will rise and fall with the water level within the reservoir tank 3, such that a substantial uniform and predetermined amount of each wicking element extends above the water level and constitutes a constant evaporative area for the wicking cartridges or elements 27, 27. This insures that the wetted surface area of the wicking elements 27, 27 remain substantially constant, regardless of the rise and fall of the water W within the reservoir tank 3. Further, the above described construction of the supporting housings 25, 25, with wicking elements 27, 27 carried thereby, permits the wicked cartridges or elements 27, 27 to be readily removed from the floating wick assemblies 15, 15 for cleaning or replacement, as desired.

In view of the above, it will be seen that the other objects of this invention are achieved and other advantage results obtained.

As various changes could be made in the above constructions without departing from the scope of the invention, it is intended that all matter obtained in the above description or shown in the accompanying drawings shall be interpreted as illustrative and not in a limiting sense.

We claim:

1. A humidifier comprising:

a water reservoir tank for holding a supply of water;

a fan mounted in fixed position relative to an upper end of said reservoir tank;

a pair of spaced and independently floatable wick elements extending across said reservoir tank and being in operative association with the water, said wick elements each having an evaporative surface which extends a substantially uniform and predetermined amount above the water as the water level in the tank rises and falls to provide a constant evaporative area for said wick element;

means forming an extensible and collapsible closed air flow path between said wick elements and said fan and including said pair of spaced and independently floatable wick elements each contained within a supporting housing that is slidably mounted relative to opposing walls of said reservoir tank, said supporting housings being spaced from each other and each including a generally vertically extending upper wall panel extending between said opposing walls and also slidably mounted with respect to said opposing walls so as to define said extensible and collapsible air flow path between the slidable upper wall panels and spaced supporting housings and interengaged opposing walls of said reservoir tank;

means forming an outside air flow path extending within said tank and communicating between substantially open upper areas of said tank and at least part of the constant evaporative area of said wick element that is also exposed to said outside air flow path; and said fan above said extensible and collapsible closed air flow path also being in air flow communication with said outside air flow path through said wick elements;

whereby said fan may be operated to draw air into said outside air flow path for contact with the constant evaporative area of said wick element while also drawing air with increased humidity through said constant evaporative area and upwardly through said closed flow path means for discharge from said humidifier into the surrounding atmosphere.

2. The humidifier as defined in claim 1 wherein said reservoir tank includes outside air openings along an upper transverse top and at least partially along an upper area of the walls of said reservoir tank that communicates with said fan in said outside air flow path above said extensible and collapsible closed air flow path, said outside air flow path extending outside of the slidable upper wall panels and interengaged opposing walls of said reservoir tank, enabling air to be drawn therein by said fan for contact with said wicking elements and for subsequent withdrawal through said extensible and collapsible air flow path for discharge of air with increased humidity from said humidifier.

3. The humidifier as defined in claim 2 wherein said reservoir tank is generally rectangularly-shaped with two opposing pairs of longer and smaller side walls, said supporting housings including said upper wall panels extending between said smaller pair of side walls.

4. The humidifier as defined in claim 3 wherein said upper wall panels including said supporting housings have an aligned track on opposite sides thereof for complementary engagement with corresponding aligned grooves provided in the smaller pair of opposed side walls of said tank for cooperation with each supporting housing.

5. The humidifier as defined in claim 4 wherein each supporting housing comprises an open-ended rectangular-shaped housing with said upper wall panel thereof being centrally located and extending vertically upwardly from said supporting housings.

6. The humidifier as defined in claim 5 wherein each supporting housing includes a splash guard centrally positioned relative to and supported by an associated supporting housing and upper wall panel, each said splash guard extending transversely from one respective upper wall panel and extending towards one of the shorter side walls of said reservoir tank.

7. The humidifier as defined in claim 6 wherein each supporting housing and associated wick element contained therein is mounted on a floatable base which positions said wick element with said constant evaporative area relative to water within said reservoir tank.

8. The humidifier as defined in claim 7 wherein each wick element is a cartridge which may be readily removed from said supporting housing when the latter is slidably removed from said reservoir tank.

9. The humidifier as defined in claim 8 wherein each wick element has a core of sheet wicking material with air passageways therethrough for enabling water to be first retained by said sheet wicking material and then removed as increased humidified air passes through said air passageways.

10. The humidifier as defined in claim 9 wherein said fan housing includes elongated sealing gaskets on opposite sides thereof for sliding sealing engagement with the upper wall panels of said supporting housings to maintain the integrity of said closed air flow path.

* * * * *

UNITED STATES PATENT AND TRADEMARK OFFICE

CERTIFICATE OF CORRECTION

PATENT NO. : 4,865,775

DATED : September 12, 1989

INVENTOR(S) : Steiner et al.

It is certified that error appears in the above-identified patent and that said Letters Patent is hereby corrected as shown below:

Column 1, line 9 "156,59" should be "156,598"

Column 8, line 7 is "air fl path" should be "air flow communication path".

Signed and Sealed this

Thirtieth Day of October, 1990

*Attest:*

HARRY F. MANBECK, JR.

*Attesting Officer*

*Commissioner of Patents and Trademarks*